US010349199B2

(12) United States Patent
Hayashi et al.

(10) Patent No.: US 10,349,199 B2
(45) Date of Patent: Jul. 9, 2019

(54) ACOUSTIC ARRAY SYSTEMS

(71) Applicant: BOSE CORPORATION, Framingham, MA (US)

(72) Inventors: Soichiro Hayashi, Tokyo (JP); Akira Mochimaru, Natick, MA (US); Marco Panzanella, Northbridge, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/581,452

(22) Filed: Apr. 28, 2017

(65) Prior Publication Data

US 2018/0317035 A1 Nov. 1, 2018

(51) Int. Cl.
*H04S 7/00* (2006.01)
*H04R 1/40* (2006.01)
(Continued)

(52) U.S. Cl.
CPC ..... *H04S 7/302* (2013.01); *H04R 1/403* (2013.01); *H04R 3/12* (2013.01); *H04R 5/02* (2013.01);
(Continued)

(58) Field of Classification Search
CPC ..... H04S 7/302; H04S 3/008; H04S 2400/01; H04S 2400/03; H04S 2400/13;
(Continued)

(56) References Cited

U.S. PATENT DOCUMENTS 6,128,395 A 10/2000 De Vries
7,260,235 B1 8/2007 Henricksen et al.
(Continued)

FOREIGN PATENT DOCUMENTS

EP 1703773 A2 9/2006
EP 1705955 A1 9/2006
(Continued)

OTHER PUBLICATIONS

Meyer, P., "DSP Beam Steering with Modern Line Arrays", Technical Report, Dec. 2002. Retrieved from: <URL: http://www.meyersound.de/support/papers/beam_steering.pdf> on Jul. 26, 2017.
(Continued)

*Primary Examiner* — Jason R Kurr
(74) *Attorney, Agent, or Firm* — Lando & Anastasi, LLP

(57) ABSTRACT

An acoustic array system includes a sound field controller and an acoustic transducer array. The sound field controller provides first and second processed signals. The first processed signal is associated with a first acoustic radiation pattern and the second processed signal is associated with a second acoustic radiation pattern. The transducer array receives the first and second processed signals from the sound field controller and produces first and second driver signals for each of the transducers. The first driver signals are based upon the first processed signal and the second driver signals are based upon the second processed signal. The transducer array combines the first and second driver signals for each of the transducers to produce a plurality of combined driver signals, one for each of the transducers, and provides the combined driver signals to the transducers.

23 Claims, 5 Drawing Sheets

(51) Int. Cl.

| | |
|---|---|
| ***H04R 3/12*** | (2006.01) |
| ***H04R 5/02*** | (2006.01) |
| ***H04R 5/04*** | (2006.01) |
| ***H04S 3/00*** | (2006.01) |

(52) U.S. Cl.
CPC ..... *H04R 5/04* (2013.01); *H04S 3/008* (2013.01); *H04R 2201/401* (2013.01); *H04R 2203/12* (2013.01); *H04R 2430/01* (2013.01); *H04S 2400/01* (2013.01); *H04S 2400/13* (2013.01)

(58) Field of Classification Search
CPC . H04R 1/403; H04R 3/12; H04R 5/02; H04R 5/04; H04R 2203/12; H04R 2430/01; H04R 2420/07; H04R 2201/401
See application file for complete search history.

(56) References Cited

U.S. PATENT DOCUMENTS

| | | | | |
|---|---|---|---|---|
| 7,577,260 | B1 * | 8/2009 | Hooley | F41H 13/0081 381/307 |
| 7,936,891 | B2 | 5/2011 | Henricksen et al. | |
| 8,199,925 | B2 * | 6/2012 | Konagai | H04R 1/403 381/116 |
| 2005/0041530 | A1 * | 2/2005 | Goudie | H04R 1/403 367/138 |
| 2006/0018490 | A1 | 1/2006 | Stiles et al. | |
| 2007/0230724 | A1 * | 10/2007 | Konagai | H04R 3/12 381/303 |
| 2009/0060236 | A1 | 3/2009 | Johnston et al. | |
| 2010/0220877 | A1 | 9/2010 | Ishibashi et al. | |
| 2011/0135125 | A1 | 6/2011 | Zhan et al. | |
| 2013/0039512 | A1 | 2/2013 | Miyata et al. | |
| 2013/0089217 | A1 * | 4/2013 | Kelloniemi | H04R 27/00 381/77 |
| 2013/0108078 | A1 | 5/2013 | Ma | |
| 2018/0077491 | A1 * | 3/2018 | Butler | H04B 3/542 |
| 2018/0220235 | A1 | 8/2018 | McKinnon et al. | |
| 2018/0242097 | A1 * | 8/2018 | Kriegel | H04R 1/403 |

FOREIGN PATENT DOCUMENTS

| | | | |
|---|---|---|---|
| EP | 1760920 | A1 | 3/2007 |
| WO | 2012032335 | A1 | 3/2012 |
| WO | 2017025151 | A1 | 2/2017 |

OTHER PUBLICATIONS

"The JBL Intellivox Range", JBL Professional Brochure, 2015. Retrieved from: <URL: http://www.jblpro.com/ProductAttachments/Intellivox_Brochure.pdf> on Jul. 26, 2017.

"K&F Vida L and Vida C", User's Manual, Version 1.8, pp. 1-63, Feb. 21, 2017. Retrieved from: <URL: http://www.kling-freitag.com/content/uploads/man_vida-l_en.pdf> on Jul. 26, 2017.

"Pan Beam PB 16—Active Digital Steerable Column Speaker", Pan Acoustics Data Sheet, 2016. Retrieved from: <URL: http://www.pan-acoustics.de/uploads/pics/PA_Datasheet_PB16_ENG_01.pdf> on Jul. 26, 2017.

Goertz, A., "Qflex DSP-controlled Tannoy array with high-end technology", Professional System Test Report, pp. 1-7, Apr. 2009.

"Active Line Array Speaker Systems SR-D8-M, SR-D8-S", TOA Corporation, Installation Manual, pp. 1-36, Retrieved from: <URL: http://www.toaelectronics.com/media/srd8_mi1e.pdf> on Jul. 26, 2017.

"Active Line Array Speaker System SR-D8", TOA Electronics, Inc., pp. 1-4, Retrieved from: <URL: http://www.toaelectronics.com/media/srd8m-cu_cb1e.pdf> on Jul. 26, 2017.

International Search Report and Written Opinion in application No. PCT/US2018/029745 dated Jul. 16, 2018.

International Search Report and Written Opinion in application No. PCT/US2018/029721 dated Jul. 6, 2018.

* cited by examiner

ACOUSTIC ARRAY SYSTEMS

CROSS REFERENCE TO RELATED APPLICATIONS

This application is related to U.S. patent application Ser. No. 15/581,668 titled SPEAKER ARRAY SYSTEMS filed on Apr. 28, 2017, which is incorporated herein by reference in its entirety for all purposes.

TECHNICAL FIELD

Aspects and examples of the present disclosure are directed generally to audio systems, and in some examples, more specifically to audio systems for providing beam steered audio to an audience.

BACKGROUND

Beam steering audio array systems include multiple speaker drivers and control the gain and delay of the signals sent to the drivers so that their combined effect is to direct acoustic energy so that it favors a particular direction, such as toward a central portion of an audience, and so that it provides certain desirable coverage, so that all members of the audience receive an acceptable audio experience, for example. Traditional array systems may be able to generate two beams by sub-dividing the drivers in the array, using some of the drivers for the formation of a first beam and others of the drivers for formation of a second beam, causing each beam to be less effective than if the entire set of drivers were used. Additionally, traditional array systems may include complex or user-unfriendly methods of changing or adapting the beam steering or other acoustic characteristics of the array, and may include drivers of different sizes to handle different portions of the frequency spectrum at additional cost and complexity with reduced reliability.

SUMMARY OF THE INVENTION

Aspects and examples are directed to array systems and methods, and signal processing systems and methods, that provide improved acoustic characteristics, including beam steering and coverage, at lower cost than conventional array systems, and allow creation of multiple steered beams, each generated by the full set of drivers in the array, thus allowing more precise beam shaping.

According to one aspect, an acoustic array system includes a sound field controller having at least one signal processor configured to process an audio signal to provide a first processed signal associated with a first acoustic radiation pattern and to provide a second processed signal associated with a second acoustic radiation pattern, and an acoustic transducer array including at least one signal processor and a plurality of acoustic transducers, the acoustic transducer array configured to receive the first and second processed signals from the sound field controller, produce a first driver signal for each of the acoustic transducers based upon the first processed signal, produce a second driver signal for each of the acoustic transducers based upon the second processed signal, and combine the first and second driver signals for each of the plurality of acoustic transducers to produce a plurality of combined driver signals, one for each of the acoustic transducers, and provide at least one combined driver signal to each of the acoustic transducers.

In some examples, the acoustic transducer array is configured to produce the first driver signal for each of the acoustic transducers based at least in part upon a parameter associated with the first acoustic radiation pattern. The parameter may include a gain, an amplitude, a time delay, a phase delay, a finite impulse response, and/or an equalization. The sound field controller may store the parameter and provide the parameter to the acoustic transducer array.

In certain examples, the sound field controller is configured to select an amplitude and delay of each of the plurality of acoustic transducers to cause the acoustic transducer array to generate the first acoustic radiation pattern. The sound field controller may provide the amplitude and delay of each of the plurality of acoustic transducers to the acoustic transducer array, and the acoustic transducer array may apply the amplitude and delay to each of the plurality of acoustic transducers.

In some examples, the array system includes a second acoustic transducer array configured to receive the first and second processed signals from the first acoustic transducer array.

According to another aspect, an acoustic array system includes a first signal processor configured to process an audio signal to provide a first beam signal associated with a first acoustic radiation pattern and a second beam signal associated with a second acoustic radiation pattern, a first plurality of signal processor channels configured to receive the first beam signal and process the first beam signal to provide a first plurality of transducer signals, a second plurality of signal processor channels configured to receive the second beam signal and process the second beam signal to provide a second plurality of transducer signals, a plurality of combiners, each configured to combine one of the first plurality of transducer signals with one of the second plurality of transducer signals to provide a combined transducer signal, and a plurality of acoustic transducers, each of the acoustic transducers configured to receive one of the plurality of combined transducer signals and convert the combined transducer signal into an acoustic wave.

In some examples, the first plurality of signal processor channels is configured to provide the first plurality of transducer signals based at least in part upon a parameter associated with the first acoustic radiation pattern. The parameter may include a gain, an amplitude, a time delay, a phase delay, a finite impulse response, and/or an equalization. The array system may include a memory to store the parameter and to provide the parameter to the first plurality of signal processor channels.

Some examples include a controller configured to select an amplitude and delay of each of the plurality of acoustic transducers to cause the acoustic transducer array to generate the first acoustic radiation pattern. The controller may provide the amplitude and delay of each of the plurality of acoustic transducers to the first plurality of signal processor channels, and the first plurality of signal processor channels may apply the amplitude and delay to the first beam signal to provide the first plurality of transducer signals.

In certain examples, the array system includes a second plurality of acoustic transducers configured to receive the first and second processed signals.

According to another aspect, a method of producing an acoustic sound field is provided and includes receiving an audio signal, processing the audio signal in accord with a first radiation pattern to provide a first beam signal, processing the audio signal in accord with a second radiation pattern to provide a second beam signal, processing the first beam signal to provide a first plurality of transducer signals, processing the second beam signal to provide a second plurality of transducer signals, combining each of a respective one of the first plurality of transducer signals with a respective one of the second plurality of transducer signals, to provide a plurality of combined transducer signals, and providing the plurality of combined transducer signals to a plurality of transducers.

In some examples, processing the first beam signal to provide a first plurality of transducer signals is based at least in part upon a parameter associated with the first radiation pattern. The parameter may include a gain, an amplitude, a time delay, a phase delay, a finite impulse response, and/or an equalization. The method may include storing the parameter and providing the parameter to a signal processor that performs the processing the first beam signal to provide a first plurality of transducer signals.

Some examples include selecting a set of amplitude and delay parameters applied to be applied in processing the first beam signal for each of the first plurality of transducer signals to cause the plurality of transducers to generate the first radiation pattern. Further examples include communicating the set of amplitude and delay parameters to a signal processor that performs the processing the first beam signal to provide a first plurality of transducer signals.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the invention. In the figures, identical or nearly identical components illustrated in various figures may be represented by a like numeral. For purposes of clarity, not every component may be labeled in every figure. In the figures.

DETAILED DESCRIPTION

Figure 1:
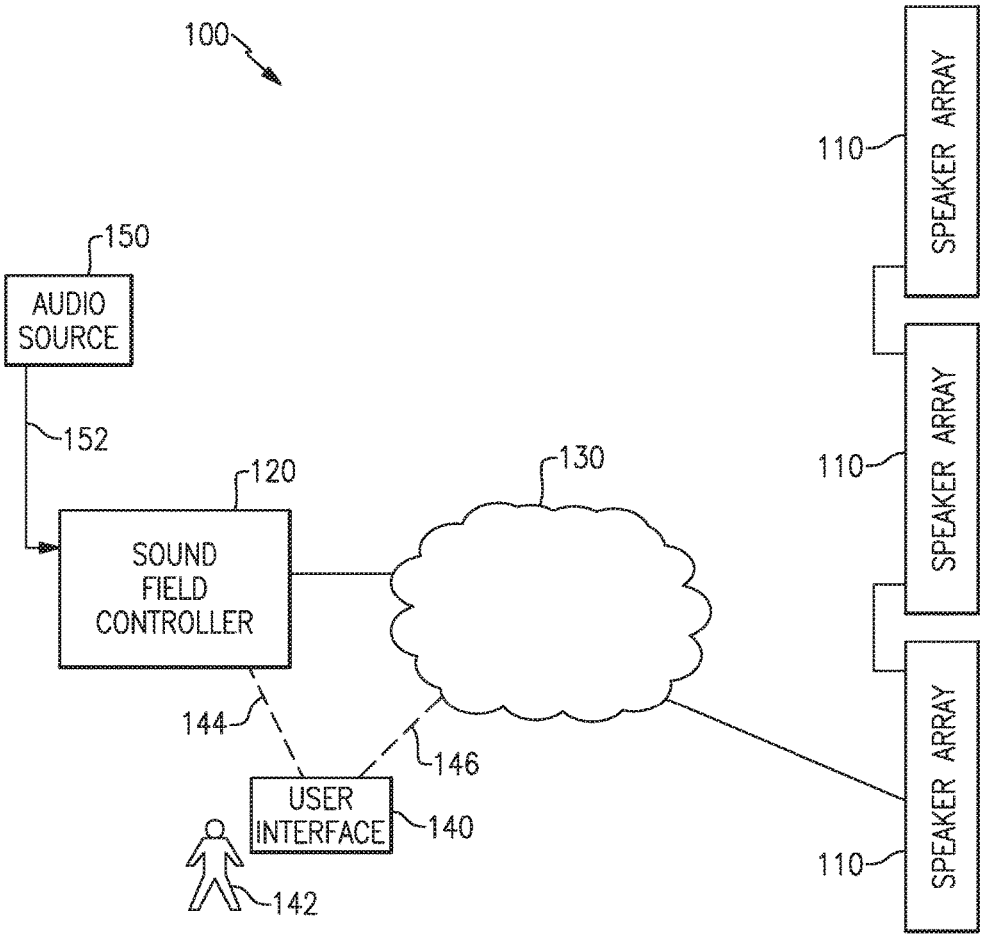
FIG. 1 is a block diagram of an example of an array system.

Aspects of the present disclosure are directed to acoustic array systems and methods that produce a complex sound field including multiple acoustic radiation patterns, such as two or more beams, by separately processing each beam signal for each driver and superimposing (e.g., adding) the beam signals just prior to providing a combined amplified signal to each driver. Acoustic arrays produce particular radiation patterns by, in most cases, providing individual signals to each driver in the array, where the individual signals vary by one or more of delay, amplitude, phase shift, etc. Calculating and applying individual signal processing per driver to form multiple beams traditionally requires array parameters (delay, amplitude, etc.) per driver that incorporate all the beams, making it difficult to make adjustment to one beam without affecting others, or requiring re-calculation and re-transmission of an extensive set of array coefficients, or else requiring the first beam to be formed by one set of drivers and the second beam to be formed by a second set of drivers, and so on, thus reducing the total number of drivers used to produce each beam as compared to when the array is used to produce only one beam.

The acoustic array systems disclosed herein may include, in some examples, a speaker array coupled to a sound field controller to produce an acoustic sound field having multiple beams. The sound field controller may include and apply signal processing common to all drivers for both beams, and may further apply beam-specific processing, e.g., through two channels, one for each beam, common to all drivers on a per-beam basis. The speaker array may receive two signals, one for each beam, from the sound field controller and may process each received signal separately for each driver, to generate multiple beam signals per driver, i.e., for two beams there are 2N signals in total where N is the number of drivers in the speaker array. Accordingly there is at least a pair of beam signals for each driver. The speaker array further processes the signals to combine all beam signals per driver, and provides each combined signal to a respective driver.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

It is to be appreciated that examples of the methods and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

FIG. 1 illustrates an example of an audio system 100 including three speaker arrays 110 interconnected in a daisy-chain arrangement, a sound field controller 120 in communication with the speaker arrays 110 through a network 130, and a user interface 140 from which a user 142 may operate and control various settings and parameters of the speaker arrays 110 to determine characteristics of an acoustic sound field created by the speaker arrays 110. Although three speaker arrays 110 are shown, any number of speaker arrays 110 may be supported, including additional speaker arrays 110 or a single speaker array 110. The sound field controller 120 may be in communication with the speaker arrays 110 through any suitable communications network 130, which may include a direct interface via wireless or wired interconnection or a network infrastructure including one or more routers, switches, and the like. In a certain example, the sound field controller 120 communicates with the speaker arrays 110 by a digital audio networking interface, such as Dante™ by Audinate, Inc., using an Internet Protocol (IP) over any suitable physical layer, e.g., optical, twisted pair, wireless, etc.

The speaker arrays 110 each include a number of drivers, which are electroacoustic transducers that convert an electrical audio signal into an acoustic signal, e.g., an acoustic pressure wave. Each driver's acoustic pressure wave interacts with other drivers' acoustic pressure waves, constructively and destructively interfering at various distances and angles from the speaker array 110, to form a certain acoustic response at each location within a room, and of particular interest at each audience member location within the room. The intensity of the sound at each position in the room, and the intensity variation for different frequencies (e.g., the tone or balance of the sound) is comprehensively referred to herein as a sound field, an acoustic field, or an acoustic sound field.

The sound field controller 120 may receive from an audio source 150 an audio signal 152 that the sound field controller 120 processes and passes to the speaker arrays 110. The sound field controller stores system parameters for processing the audio signal 152, such as system gain, system equalizer, and system delay settings, and stores beam settings such as gain and delay parameters for each of the drivers in the speaker arrays 110. The sound field controller 120 communicates the delay and gain parameters to the speaker arrays 110 via one or more control messages through the communication network 130. For each driver among the speaker arrays 110, a delay and gain applied to the audio signal causes the driver to produce acoustic pressure at the right time and with the right intensity to cause the proper interaction among the acoustic pressure waves to form the intended sound field.

In addition, the sound field controller 120 may store finite impulse response (FIR) parameters for each driver. FIR parameters may be stored in the form of a finite impulse response waveform or may be in the form of FIR filter coefficients that, when applied to a FIR filter, produce an associated response to a filtered audio signal. Finite impulse response parameters may provide desired phase delays for different frequencies that a typical time delay (applied equally to all frequencies) could not, but is not necessarily required in all cases. Additionally, finite impulse response parameters may incorporate each of a time delay common to all frequencies, a gain common to all frequencies, and equalization as desired. In certain examples, however, the delay, gain, and equalization for each driver in the speaker arrays 110 is managed by separate parameters, and FIR parameters are used to fine tune beam steering and spreading and to make frequency-specific adjustment to the same. In certain examples, FIR parameters are optional or not included.

In addition, the sound field controller 120 may store equalization parameters for each driver. The equalization parameters for each driver may include equalization parameters to compensate for a native frequency response of each driver based upon component testing, or the frequency response of each driver in combination with the enclosure and mounting of the driver in the speaker array 110, or the frequency response of the set of all drivers in each speaker array 110, again in combination with the enclosure and mounting of the drivers in the speaker array 110. In the latter case, equalization parameters stored by the sound field controller 120 may be identical for each of the drivers within a single speaker array 110, or for all the drivers among all the speaker arrays 110.

In some examples, the speaker array(s) 110 may receive array parameters and/or equalization in a different manner. For example, the sound field controller 120 in some examples may not store the parameters, or the speaker array(s) 110 may not use the parameters or equalization stored by the sound field controller 120, and may use parameters and/or equalization received from elsewhere, such as from a configuration tool, or as previously preloaded equalization and/or array parameters stored in memory associated with the speaker array(s) 110.

The sound field controller 120 has, or may communicate with, a user interface 140 that may include, for example, one or more user input devices such as a keyboard, mouse, touch-sensitive screen, and the like, and may include one or more user output devices, such as a screen, monitor, lights, buzzers, and other indicators, and the like. The user interface 140 may be integrated with the sound field controller 120, or may be remote to the sound field controller 120 via a direct connection 144 or via a network connection 146 through the network 130 or other suitable communications interface(s). For example, the user interface 140 may include a remote computer, workstation, or device, proprietary or non-proprietary, such as a laptop, desktop, tablet, smartphone, etc., and such may have dedicated software that displays user information and options and communicates with the sound field controller 120, or may have general software, such as a web browser, that communicates with the sound field controller 120 via e.g., a web server hosted by the sound field controller 120.

The user interface 140 may allow a user 142 to select a sound field from among multiple pre-loaded sound fields. Additionally, the sound field controller 120 coupled with the user interface 140 may allow creation of new sound fields by the calculation of new array parameters. In general, signal processing channels of the sound field controller 120 and the speaker arrays 110, each discussed in more detail below, process signals to create a desired sound field using array parameters that may include amplitude, gain, time delay, phase delay, equalization, finite impulse response, and other parameters as appropriate to a certain desired sound field. In a certain example, the array parameters applied include amplitude and time delay. In a further example, the array parameters applied also include FIR coefficients.

Such array parameters may be required by the system, e.g., audio system 100, but are generally not "user friendly" in that they are not easily chosen or modified by the user 142. Accordingly, it is desired that the user 142 may work with user friendly parameters that define the desired sound field or beam characteristics, such as beam direction, spreading, tonal balance, and the like. Accordingly, a sound field tool may be incorporated into the sound field controller 120 to allow calculation of array parameters from user-specified sound field parameters. Alternatively, a sound field tool may exist separate from the sound field controller 120, and the audio system 100, and may provide one or more sets of array parameters that may be loaded, programmed, stored, or otherwise used with the audio system 100. In certain examples, the sound field controller 120 may include memory or other storage capability to store such array parameters.

The audio signal 152 is described above as coming from an audio source 150 and processed by the sound field controller 120. Additionally or alternatively, the sound field controller 120 may store one or more portions, or all, of the audio signal 152 to be provided to the speaker arrays 110. In other examples, the audio signal 152 may be provided to the speaker arrays 110 through a different mechanism, such as directly to an audio input associated with one of the speaker arrays 110.

Figure 2:
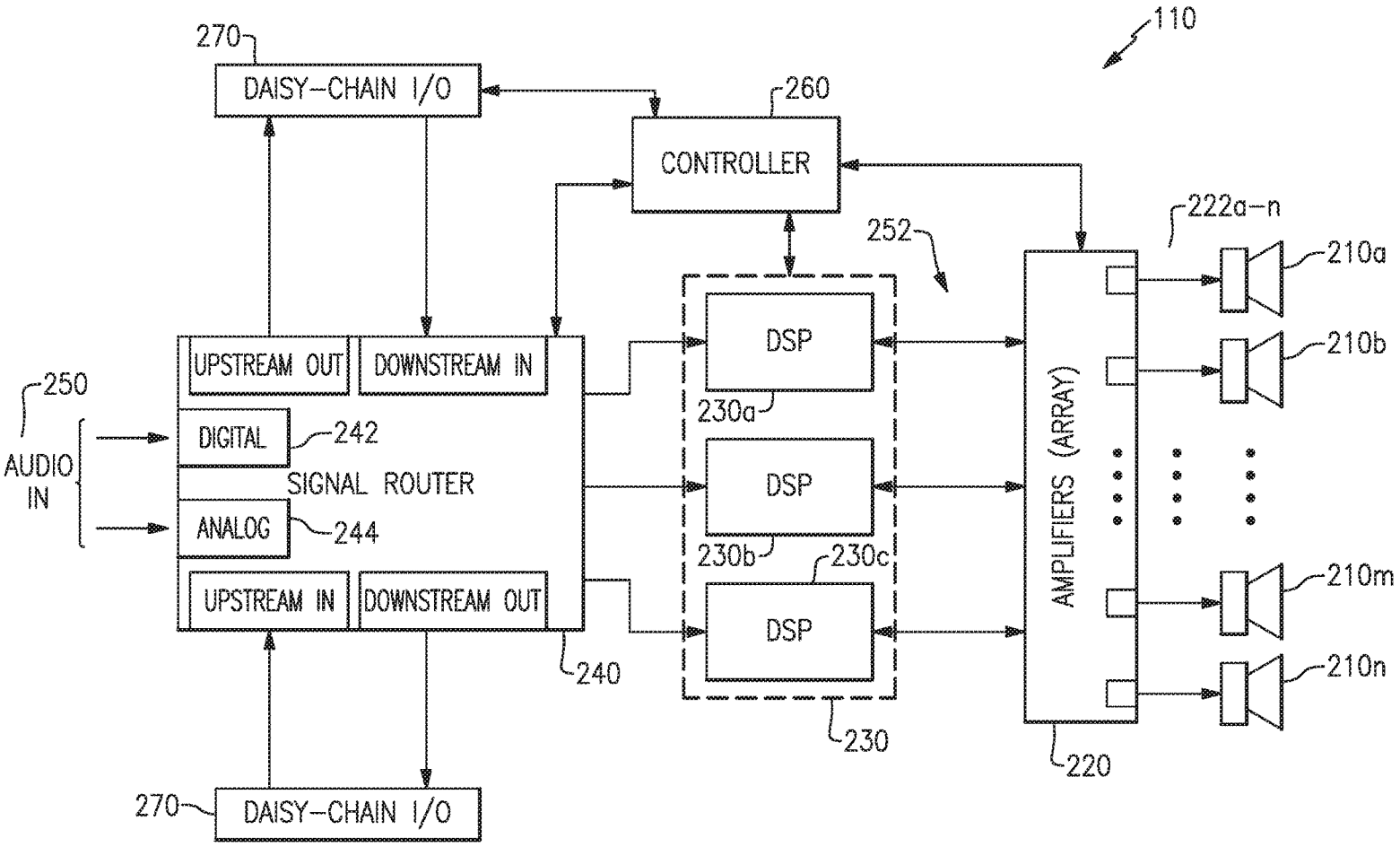
FIG. 2 is a block diagram of an example of a speaker array.

FIG. 2 illustrates an example of a speaker array 110 that includes a number of drivers 210 with an array of amplifiers 220 and a bank of digital signal processors (DSP) 230. A signal router 240 routes an audio signal 250, received at one of a digital interface 242 or an analog interface 244, to the DSP bank 230 which processes the audio signal 250 individually for each driver 210 and provides processed signals 252, one for each driver, to the amplifiers 220. The amplifiers 220 provide an amplified processed signal 222 to each of the drivers 210. A speaker array 110 may have any number of drivers 210, amplifiers 220, and DSP's 230.

In a particular example, a speaker array 110 has twelve drivers 210, twelve amplifiers 220, and three DSP's 230, each having four DSP channels for a total of twelve DSP channels. Accordingly, there is at least one DSP channel and at least one amplifier channel per driver 210 such that each driver 210 may receive a unique amplified processed signal 222 produced from the received audio signal. Each DSP 230 channel applies a delay to the received audio signal 250 to provide the processed signal 252, in accord with a delay parameter communicated from the sound field controller 120. Each DSP 230 channel may also apply equalization in accord with equalization parameters received from the sound field controller 120, and may additionally or alternatively apply pre-stored equalization in accord with pre-stored equalization parameters. Each DSP 230 channel may also apply a gain in accord with a gain parameter received from the sound field controller 120, and may apply a FIR filter in accord with FIR parameters received from the sound field controller 120. In certain examples, gain parameters received from the sound field controller 120 are applied by the amplifiers 220 instead of, or in addition to, the DSP 230 channels.

In certain examples, equalization applied by the DSP 230 channels compensates for a frequency response of the speaker array 110, as discussed above. In certain examples, the sound field controller 120 may apply equalization to the audio signal 152 associated with various frequency responses, such as, for example, to compensate for frequency response of the room in which the speaker array 110 is operated, to compensate for tonal balance or frequency coloring anticipated or resulting from the beam forming process (e.g., gain, delay, FIR filters), and/or to apply a user desired equalization, tone adjustment, or color.

Still referring to FIG. 2, the speaker array 110 may include a controller 260 that communicates with and controls the various components of the speaker array 110. For example, the controller 260 may be a processor that communicates with the sound field controller 120 (via, e.g., digital interface 242) to receive the various array parameters. The controller 260 may load or establish the parameters (e.g., gain, delay, FIR) into the DSP 230 channels and the amplifiers 220. The controller 260 also may control the signal router 240 to select the interface upon which to receive the audio signal 250, e.g., digital 242 or analog 244, and may receive the audio signal 250 from another (e.g., upstream) speaker array 110 and/or provide the audio signal 250 to another (e.g., downstream) speaker array 110 via a daisy-chain input/output interface 270.

Further, the controller 260 may detect the presence of upstream and downstream speaker arrays 110, may receive or provide beam forming or array parameters from/to an upstream or downstream speaker array 110, may communicate with the sound field controller 120 about the presence of upstream and downstream speaker arrays 110, may receive array parameters or other communications for an upstream or downstream speaker array 110 and communicate the parameters to the upstream or downstream speaker array 110, and may receive communication from an upstream or downstream speaker array 110 for the sound field controller 120 and communicate it to the sound field controller 120. In certain examples, the controller 260 may be an integrated component that includes the signal router 240 and/or the interfaces 242, 244, 270, and may include or be incorporated in one or more of the DSP's 230. Any suitable processor with suitable programming, or suitable logic, such as an application specific integrated circuit (ASIC), or programmable gate array, for example, may serve as the controller 260 or a portion thereof.

Figure 3:
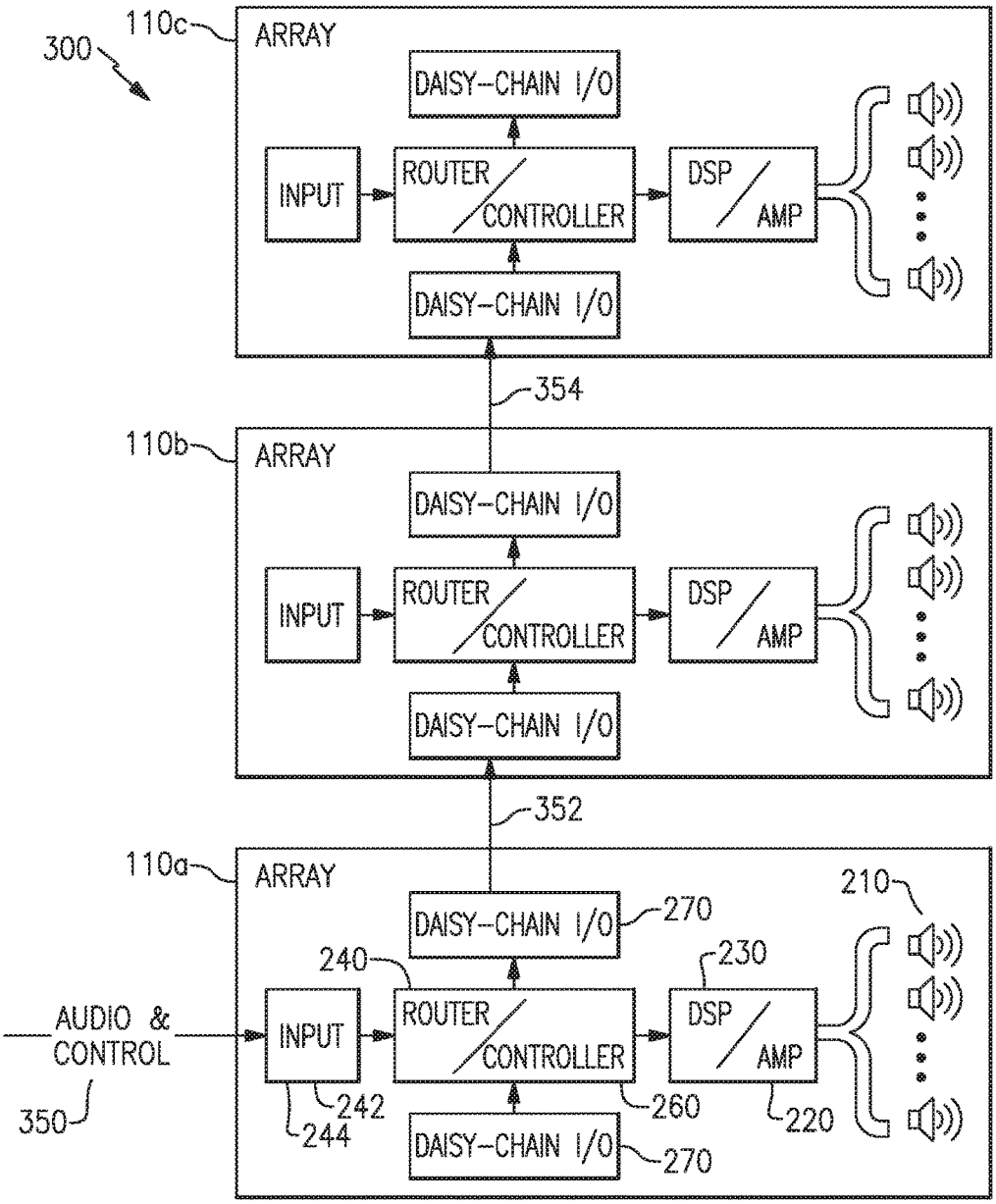
FIG. 3 is a block diagram of an example of a stacked array.

FIG. 3 illustrates a stacked array 300 which is a daisy-chained set of speaker arrays 110. A single speaker array 110 may be used alone, but certain examples of speaker array systems as disclosed herein allow for daisy-chaining two or more speaker arrays 110 to provide a larger array having a greater number of drivers 210, which allows for more extensive control and tailoring of the sound field produced by the stacked array 300 than may be achieved by a single speaker array 110. It should be noted that it may not be necessary to form a stacked array 300 for all applications or in all situations. The ability to form a stacked array 300 may provide increased flexibility to accommodate changing requirements or specific applications. For example, a certain room size or shape may benefit from a stacked array 300 to provide more detailed beam forming, while for a smaller room or different shape a single speaker array 110 may be sufficient.

The stacked array 300 in FIG. 3 includes a first speaker array 110*a*, a second speaker array 110*b*, and a third speaker array 110*c*. Further examples of a stacked array may include only two speaker arrays 110 or may include four or more speaker arrays 110. In the example shown in FIG. 3, the first speaker array 110*a* receives audio and control signals 350, for example as may be received from a sound field controller 120 (see FIG. 1) as discussed above. The first speaker array 110*a* communicates via a daisy-chain connection 352 with the second speaker array 110*b* to pass relevant portions of the audio and control signals 350 to the second speaker array 110*b*. Likewise, the second speaker array 110*b* communicates via a daisy-chain connection 354 with the third speaker array 110*c* to pass relevant portions of the audio and control signals 350 to the third speaker array 110*c*.

Each of the speaker arrays 110 may communicate with each other via the daisy-chain connections 352, 354, and the first speaker array 110*a* may communicate with an audio source (e.g., FIG. 1, audio source 150) or a controller (e.g., FIG. 1, sound field controller 120). In certain examples, each of the speaker arrays 110 may have twelve drivers 210 and the stacked array 300 may therefore include 36 drivers. A sound field controller 120 may store and communicate array parameters, e.g., delay, gain, FIR, equalization, etc. for each driver 210 in the stacked array 300 to produce a selected (e.g., by a user 142) acoustic sound field.

Any of the speaker arrays 110 may be in direct communication with a sound field controller 120 or an audio source 150, and the terms first, second, and third are used arbitrarily in reference to the speaker arrays 110. For example, the second speaker array 110*b* could be in communication with the sound field controller 120 and receive array parameters, e.g., delay, gain, FIR, equalization, etc. for each driver 210 in the stacked array 300 and pass along the relevant parameters to the first speaker array 110*a* and the third speaker array 110*c*, as appropriate. Similarly, the stacked array 300 may be configurable so that any of the three speaker arrays 110 may receive an audio signal and pass the audio signal to the other speaker arrays 110, or each of the speaker arrays 110 may receive an audio signal directly from an audio source. In certain examples, the physical configuration and communication connectivity of the stacked array 300 may be selectable by a user 142 at a user interface 140, or may be automatically discoverable by the various systems (e.g., the speaker arrays 110 and the sound field controller 120), or any combination thereof.

Figure 4:
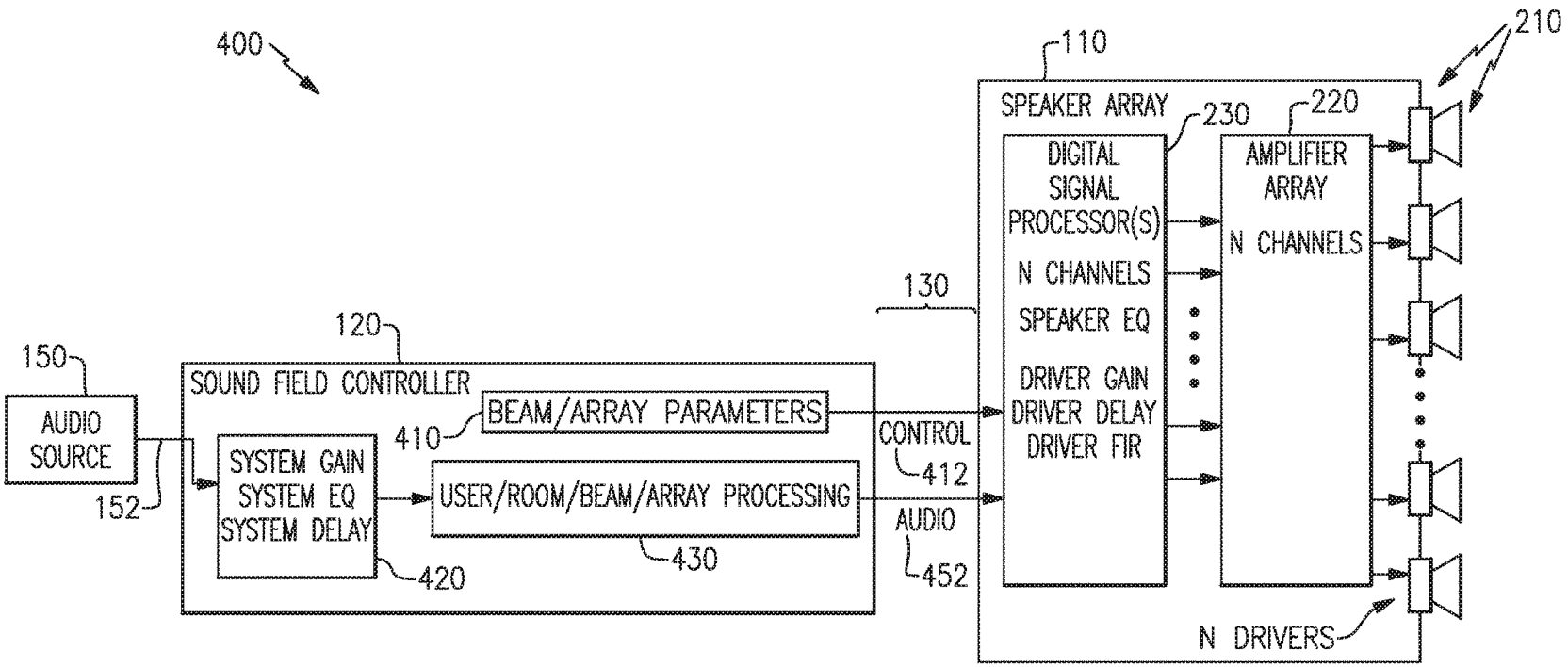
FIG. 4 is a block diagram of another example of an array system.

FIG. 4 illustrates an example of an audio system 400 including at least one speaker array 110 in communication with a sound field controller 120 through a communications channel, such as may be provided through the network 130. The sound field controller 120 stores array parameters 410 for the speaker array 110 and communicates them to the speaker array 110 through one or more control messages 412. The array parameters 410 may include gain, delay, FIR, equalization, and other parameters for each of the drivers 210 that are part of the speaker array 110. It should be noted that the array parameters 410 may include parameters for drivers 210 associated with additional speaker arrays 110 as part of a stacked array, e.g., the stacked array 300 of FIG. 3, and one or more of the speaker arrays 110 may communicate the array parameters 410 through a daisy-chain communication as discussed above.

The array parameters 410 may include parameters for beam controls, e.g., steering, direction, spreading, etc., as part of a user-selected sound field and may generally be referred to as beam parameters, though such parameters may effectuate other aspects of sound field creation other than a beam. Additionally, the array parameters 410 may include other parameters not associated with a particular beam configuration, such as equalization parameters that compensate for the frequency response of the drivers 210 mounted in the speaker array 110.

In certain examples, the sound field controller 120 communicates one set of equalization parameters that the speaker array 110 applies to all the drivers 210, such as a fixed speaker equalization that compensates for the frequency response of the speaker array 110, which may depend upon a model number or type of speaker array 110. In other examples, the sound field controller 120 may communicate different equalization parameters for different drivers 210. For example, drivers 210 at different positions in the speaker array 110 may exhibit different frequency responses and may benefit from different equalization than other drivers 210 in the speaker array 110. Additionally, different user-selected acoustic sound fields may benefit from different equalization in the speaker array 110. Equalization parameters may also be associated with beam control, as a beam pattern may create coloring of the acoustic sound field, i.e., a shifting of frequency response, which may be at least partially compensated by equalization.

The sound field controller 120 may apply processing to the audio signal 152 to produce a processed audio signal 452 that the sound field controller 120 passes to the one or more speaker arrays 110 (e.g., directly or via a daisy-chain). For example, the sound field controller 120 may provide system processing 420 that may include gain, delay, equalization, and the like, that affects all sound being produced by the audio system 400. For example, system gain and delay may be beneficial to adjust the overall sound level and timing to match other speakers in a room. For instance, the audio system 400 may process and generate a sound field for a rear channel among a set of speakers in a room and the timing and level may need to be adjusted to match a front channel, or vice-versa, or for a left-right channel pair, and the like.

Array parameters such as individual gain, delay, FIR, and equalization parameters for each of the drivers 210 may be selected by a sound field design tool that incorporates room characteristics such as shape, size, materials, audience orientation, etc. Such room characteristics may color, i.e., alter the frequency response of, the sound field produced by an acoustic array system, e.g., audio system 400. The sound field controller 120 may apply processing 430 to adjust the audio signal 152 for room characteristics, beam characteristics, or array characteristics that may be at least partially compensated by common processing 430 without regard to individual drivers 210. The altered frequency response due to room characteristics, for example, may be at least partially compensated by room equalization applied in the processing 430. Additional coloring of the sound field may be a side product of the array configuration, e.g., the model of one or more speaker arrays 110 or configuration as a stacked array 300, or a side product of desired beam characteristics, and such may be at least partially compensated by array and/or beam equalization or other adjustments in the processing 430. Additionally, the sound field controller 120 may provide user-selectable options or adjustments to the audio signal, such as equalization, tone, balance, delay, gain, etc, based upon user preferences, and such adjustments may be applied to the audio signal 152 in the processing 430. It should be understood that any characteristic, adjustment, or processing of the audio signal 152 that does not require individual adjustment at one driver 210 separately from another driver 210, may be applied in the sound field controller 120 at either of the processing 430 or the system processing 420. Such processing that commonly applies to all the drivers 210 may be collectively referred to as common processing or system processing.

Figure 5:
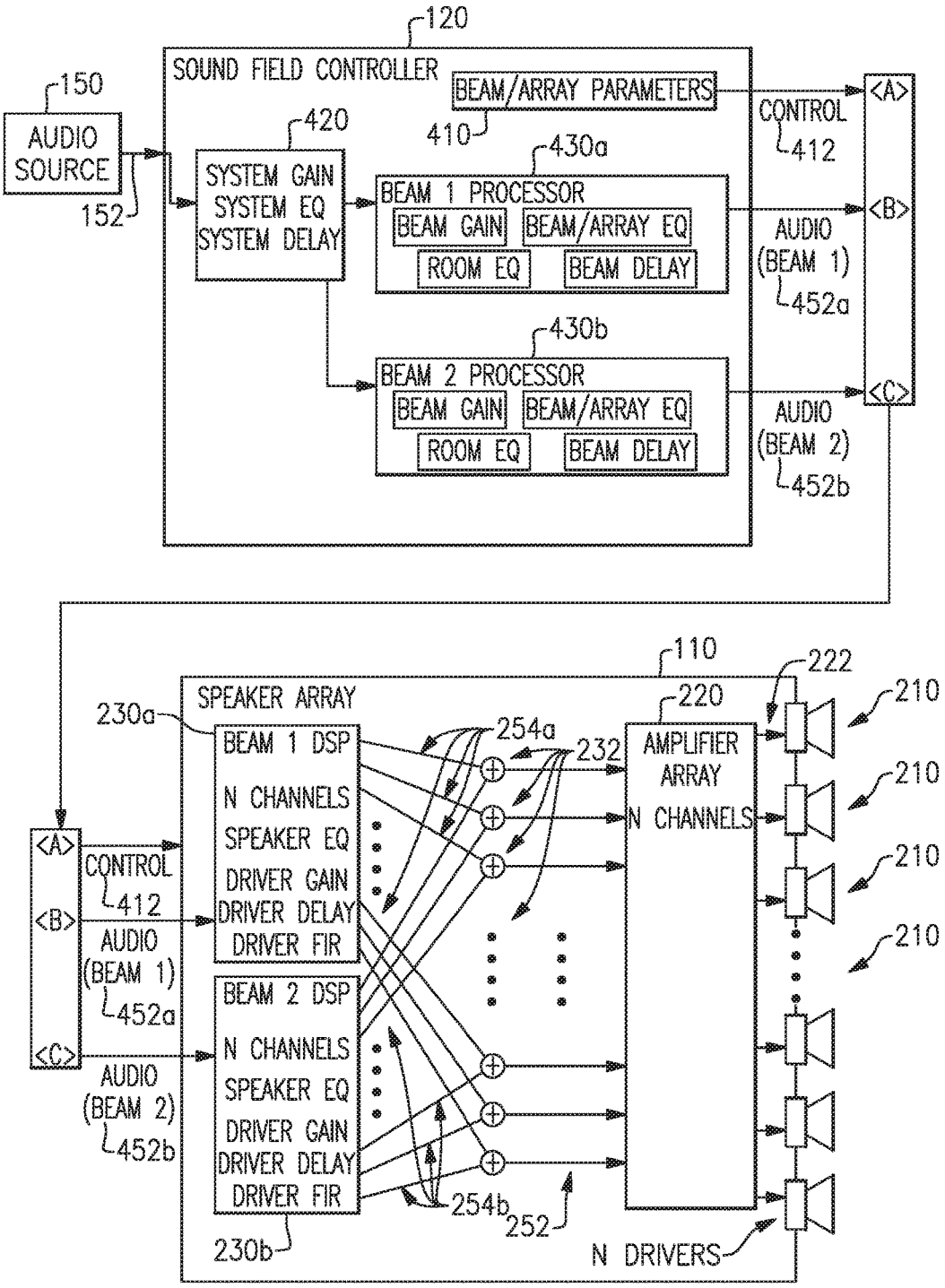
FIG. 5 is a block diagram of yet another example of an array system.

FIG. 5 illustrates an example of an audio system 500 including at least one speaker array 110 in communication with a sound field controller 120 configured to produce an acoustic sound field having two beams. Conventional array systems supporting two beams divide the number of drivers into two sets and produce one beam from each set. In some conventional systems that include more than one speaker array the drivers among the various speaker arrays are also divided into two sets and each set is used to provide one beam. This conventional approach uses half as many drivers to produce each beam as compared to a case where only one beam is being produced, thus producing beams having less desirable characteristics, such as less accuracy in the desired or intended beam pattern (e.g., direction, spreading, sidelobes, etc.). An alternate conventional approach includes calculation of a more precise response for each driver in the array to allow extensive control of the sound field produced. Such an approach is computationally challenging, requires significant calculational resources, and may require speaker arrays with significantly increased processing capability to implement the precise response required of each driver. The audio system 500, however, includes a solution that produces two beams, each beam having the precision of using all the drivers in the array, while being cheaper, less complex, and more easily adjustable than conventional, computationally extensive, approaches.

In the audio system 500, the sound field controller 120 processes the audio signal 152 through two beam processors 430*a*, 430*b* to provide two processed audio signals 452*a*, 452*b*, one for each beam. The speaker arrays 110 include two signal processor channels 230*a*, 230*b* per driver 210, one for each beam, that further process the processed audio signals 452*a*, 452*b* to provide beam-specific driver signals 254*a*, 254*b*. Each beam-specific driver signal 254*a*, 254*b* is added together, per driver, by a set of combiners 232 to provide combined processed signals 252 to the amplifiers 220, which then provide individual amplified signals 222 to each of the drivers 210. It should be understood that addition of the beam-specific driver signals 254*a*, 254*b* by the combiners 232 may be performed within one or more DSP's that implement any of the processor channels 230.

Each beam has its own set of beam-specific parameters, e.g., gain, delay, FIR, equalization, etc. per driver 210, as appropriate for the situation. Each of the beam processors 230 associated with the speaker array 110 processes one of the beams by applying the respective beam-specific parameters, per driver 210. Accordingly, the sound field controller 120 provides two sets of array parameters 410 to the speaker array(s) 110, one set of array parameters for the first beam, which are applied to the first set of processor channels 230*a*, and another set of array parameters for the second beam, which are applied to the second set of processor channels 230*b*. It should be understood from the above discussion that a speaker array 110 in accord with this example has two DSP channels per driver 210, or equivalently stated, each driver 210 has two DSP channels, one for each beam to which the driver 210 will contribute. The pair of signals produced by the two DSP channels are combined together and the combined signal is amplified before providing to the driver 210.

In such manner, each of the drivers 210 of the speaker array(s) 110 will produce an acoustic wave that combines with the acoustic waves of all the other drivers 210 to produce an acoustic sound field having two beams. Each beam will have the precision or quality of having been produced by all the drivers 210 of the array, and not just by a subset of the drivers 210.

A benefit of the example audio system 500 is that each beam is individually adjustable within the sound field controller 120 (by processors 430*a*, 430*b*) or the speaker array 110 (by processors 230*a*, 230*b*). For example, if the user 142 wants to adjust equalization or gain of one of the beams without affecting the other beam, such may be applied in one of the processors 430 of the sound field controller 120. In conventional systems individual adjustment to a single beam either requires that each beam be produced only by a subset of the drivers, or requires complex recalculation of array parameters for each driver. For example, in conventional systems that produce multiple beams using all available drivers, the information necessary to produce each beam is intermingled within the driver-specific array parameters, and not separable, thus requiring recalculation of the parameters to create all the beams when it is desired to make a change to only one of the beams. Such requires the speaker array(s) to have increased resources to perform the extensive calculations, or requires the parameters to be calculated elsewhere and transferred, requiring a significant amount of data transmission, to apply the newly calculated parameters.

It should be understood that the example audio system 500 processes signals for and produces two beams, but may be extended to any number of beams desired to accommodate varying operational demands or applications. For example, the sound field controller 120 may include additional processing 430 channels, e.g., beam 1 processing 430*a*, beam 2 processing 430*b*, beam 3 processing, and so on up to beam M processing, to provide M number of processed audio signals 452, one for each beam. The speaker array 110 may include M×N DSP 230 channels to process the M beam signals for each of the N drivers 210, and M combiners 232 to add together the M beam-specific driver signals 254 to provide N combined signals 252, one for each driver 210.

Among the various examples discussed above reference is made at times to one or more signal processing channels. It should be understood that various signal processing channels may be digital or analog in nature and that specific examples of digital signal processing channels may have analog counterparts substituted therefore, and that analog signal processing may have digital counterparts substituted therefore. It should be understood that conversion of signals from digital to analog, and vice-versa, are well known in the art and such conversion may include one or more digital-to-analog converters (DAC) and/or analog-to-digital converters (ADC), respectively. In the examples discussed above such conversion may be included though the conversion may not be discussed or shown. Those of skill in the art will understand how to make such conversion as necessary to implement the examples discussed. In particular, it should be understood that processing in a sound field controller 120, and in one or more DSP 230 channels of a speaker array 110, may occur in the digital domain while a signal (processed, combined, amplified, etc.) provided to an amplifier or to a driver may be analog. Accordingly, a DAC may be provided between, e.g., a DSP 230 and an amplifier 220, to convert a processed digital signal into an analog signal to be amplified.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. An acoustic array system comprising:

a sound field controller including a memory and a first signal processor, the memory configured to store a plurality of parameters associated with a first acoustic radiation pattern and a second acoustic radiation pattern, the plurality of parameters based upon a room configuration in which the first acoustic radiation pattern and the second acoustic radiation pattern are to be generated, the first signal processor configured to process an audio signal in accordance with the plurality of parameters to provide a first processed signal associated with the first acoustic radiation pattern and to provide a second processed signal associated with the second acoustic radiation pattern; and an acoustic transducer array configured in an enclosure separate from the sound field controller and including a second signal processor and a plurality of acoustic transducers, the acoustic transducer array configured to receive the first and second processed signals from the sound field controller, produce a first driver signal for each of the acoustic transducers based upon the first processed signal, produce a second driver signal for each of the acoustic transducers based upon the second processed signal, and combine the first and second driver signals for each of the plurality of acoustic transducers to produce a plurality of combined driver signals, one for each of the acoustic transducers, and provide at least one combined driver signal to each of the acoustic transducers, wherein each of the sound field controller and the acoustic transducer array include a communications interface configured to be coupled together, and the sound field controller is configured to communicate each of the first and second processed signals to the acoustic transducer array via the communications interface and to determine from the acoustic transducer array a number of additional acoustic transducer arrays coupled to the acoustic transducer array via one or more daisy-chain interfaces between the acoustic transducer array and the additional acoustic transducer arrays.

2. The system of claim 1 wherein the acoustic transducer array is configured to produce the first driver signal for each of the acoustic transducers based at least in part upon a parameter associated with the first acoustic radiation pattern.

3. The system of claim 2 wherein the parameter is at least one of a gain, an amplitude, a time delay, a phase delay, a finite impulse response, and an equalization.

4. The system of claim 2 wherein the sound field controller is configured to store the parameter and to provide the parameter to the acoustic transducer array.

5. The system of claim 1 wherein the sound field controller is configured to select an amplitude and delay of each of the plurality of acoustic transducers, to cause the acoustic transducer array to generate the first acoustic radiation pattern.

6. The system of claim 5 wherein the sound field controller is configured to provide the amplitude and delay of each of the plurality of acoustic transducers to the acoustic transducer array, and the acoustic transducer array is configured to apply the amplitude and delay to each of the plurality of acoustic transducers.

7. The system of claim 1 wherein the acoustic transducer array is a first acoustic transducer array, and the system further comprises a second acoustic transducer array configured to receive the first and second processed signals from the first acoustic transducer array.

8. The system of claim 1, wherein at least one of the additional acoustic transducer arrays is configured to provide beam forming or array parameters to a controller of the acoustic transducer array.

9. The system of claim 1, wherein at least one of the additional acoustic transducer arrays includes a controller configured to receive array parameters and communicate the array parameters to a controller of the acoustic transducer array.

10. The system of claim 1, wherein at least one of the additional acoustic transducer arrays includes a controller configured to receive communication from the acoustic transducer array for the sound field controller and communicate the communication to the sound field controller.

11. An acoustic array system comprising:

a sound field controller including a first signal processor configured to process an audio signal in accordance with a plurality of stored parameters associated with a room configuration in which a first acoustic radiation pattern and a second acoustic radiation pattern are to be generated, and to provide a first beam signal associated with the first acoustic radiation pattern and a second beam signal associated with the second acoustic radiation pattern;

a first plurality of signal processor channels associated with an enclosure that is not associated with the first signal processor and configured to receive the first beam signal from the first signal processor via an audio network interface and process the first beam signal in accordance with the plurality of stored parameters to provide a first plurality of transducer signals;

a second plurality of signal processor channels associated with an enclosure that is not associated with the first signal processor and configured to receive the second beam signal from the first signal processor via an audio network interface and process the second beam signal in accordance with the plurality of stored parameters to provide a second plurality of transducer signals;

a plurality of combiners, each of the plurality of combiners configured to combine one of the first plurality of transducer signals with one of the second plurality of transducer signals to provide a combined transducer signal; and a plurality of acoustic transducers, each of the plurality of acoustic transducers configured to receive one of the plurality of combined transducer signals and convert the one of the plurality of combined transducer signals into an acoustic wave, wherein the sound field controller is configured to determine from the plurality of acoustic transducers a number of acoustic transducers coupled to one another via one or more daisy-chain interfaces.

12. The system of claim 11 wherein the first plurality of signal processor channels is configured to provide the first plurality of transducer signals based at least in part upon a parameter associated with the first acoustic radiation pattern.

13. The system of claim 12 wherein the parameter is at least one of a gain, an amplitude, a time delay, a phase delay, a finite impulse response, and an equalization.

14. The system of claim 12 further comprising a memory to store the parameter and to provide the parameter to the first plurality of signal processor channels.

15. The system of claim 11 further comprising a controller configured to select an amplitude and delay of each of the plurality of acoustic transducers to cause the acoustic transducer array to generate the first acoustic radiation pattern.

16. The system of claim 15 wherein the controller is configured to provide the amplitude and delay of each of the plurality of acoustic transducers to the first plurality of signal processor channels, and the first plurality of signal processor channels is configured to apply the amplitude and delay to the first beam signal to provide the first plurality of transducer signals.

17. The system of claim 11 wherein the plurality of acoustic transducers is a first plurality of acoustic transducers, and the system further comprises a second plurality of acoustic transducers configured to receive the first and second processed signals.

18. A method of producing an acoustic sound field, the method comprising:

receiving an audio signal;

processing the audio signal, by a sound field controller including one or more first signal processors, in accordance with a plurality of stored parameters associated with a room configuration in which a first radiation pattern is to be generated, to provide a first beam signal;

processing the audio signal, by the one or more first signal processors, in accordance with the plurality of stored parameters associated with the room configuration in which a second radiation pattern is to be generated, to provide a second beam signal;

communicating the first beam signal and the second beam signal via an audio network interface to one or more additional signal processors associated with an enclosure that is not associated with the one or more first signal processors;

processing, by the one or more additional signal processors, the first beam signal in accordance with the plurality of stored parameters associated with the room configuration to provide a first plurality of transducer signals;

processing, by the one or more additional signal processors, the second beam signal in accordance with the plurality of stored parameters associated with the room configuration to provide a second plurality of transducer signals;

combining each of a respective one of the first plurality of transducer signals with a respective one of the second plurality of transducer signals, to provide a plurality of combined transducer signals;

providing the plurality of combined transducer signals to a plurality of transducers; and determining, by the sound field controller from the plurality of transducers, a number of transducers coupled to one another via one or more daisy-chain interfaces.

19. The method of claim 18 wherein processing the first beam signal to provide a first plurality of transducer signals is based at least in part upon a parameter associated with the first radiation pattern.

20. The method of claim 19 wherein the parameter is at least one of a gain, an amplitude, a time delay, a phase delay, a finite impulse response, and an equalization.

21. The method of claim 19 further comprising storing the parameter and providing the parameter to a signal processor that performs the processing the first beam signal to provide a first plurality of transducer signals.

22. The method of claim 18 further comprising selecting a set of amplitude and delay parameters applied in the processing the first beam signal for each of the first plurality of transducer signals to cause the plurality of transducers to generate the first radiation pattern.

23. The method of claim 22 further comprising communicating the set of amplitude and delay parameters to a signal processor that performs the processing the first beam signal to provide a first plurality of transducer signals.

* * * * *